United States Patent [19]

Leffel

[11] Patent Number: 4,962,720

[45] Date of Patent: Oct. 16, 1990

[54] MARINE SIGNAL FLAG

[76] Inventor: H. Pat Leffel, E. 1245 Crystal Bay Rd., Post Falls, Id. 83854

[21] Appl. No.: 402,829

[22] Filed: Sep. 5, 1989

[51] Int. Cl.[5] ..... G09F 17/00

[52] U.S. Cl. ..... 116/173; 116/28 R

[58] Field of Search ..... 40/591, 592, 601, 610; 52/110; 116/28 R, 173, 209; 248/188.5; 340/472; 343/901, 903, 709, 714, 720, 721, 894

[56] References Cited

U.S. PATENT DOCUMENTS

| | | | |
|---|---|---|---|
| 3,114,129 | 12/1963 | Gilbert | 116/173 |
| 3,117,549 | 1/1964 | Ripepe | 116/28 R |
| 3,127,869 | 4/1964 | Howland | 116/173 |
| 3,602,188 | 8/1971 | Penaflor | 116/28 R |
| 3,735,724 | 4/1973 | Miller | 116/28 R |
| 3,786,778 | 1/1974 | Palmer et al. | 116/28 R |
| 3,797,450 | 3/1974 | Frisbee | 116/28 R |
| 4,028,827 | 6/1977 | Hufton | 40/128 |
| 4,122,796 | 10/1978 | Pressler et al. | 116/28 R |
| 4,545,320 | 10/1985 | Lewis et al. | 116/28 R |
| 4,603,333 | 7/1986 | Carlson | 343/709 |
| 4,640,213 | 2/1987 | Lugo | 114/253 |
| 4,727,822 | 3/1988 | Wikkerink | 116/174 |
| 4,796,553 | 1/1989 | Cogswell et al. | 116/173 |

FOREIGN PATENT DOCUMENTS

| | | | |
|---|---|---|---|
| 2242407 | 3/1974 | Fed. Rep. of Germany | 116/28 R |

*Primary Examiner*—William A. Cuchlinski, Jr.
*Assistant Examiner*—W. Morris Worth
*Attorney, Agent, or Firm*—Wells, St. John & Roberts

[57] ABSTRACT

A self-storing flag assembly is described for mounting to the deck or similar area on a boat. the assembly will facilitate extension of a telescoping flag standard from a below deck stowed position to an upright extended operative position, displaying a flag body for the purpose of signalling adjacent water craft. The flag assembly is also retractable to a shortened inoperative position below the deck. The standard may be manually extended and contracted, or be connected to a power drive and switch operated to extend and contract. The standard is formed of interfitting telescoping sections that are loosely received within an axial tubular connector member releasably mounted at the top end of the standard. Provisions are made for securely mounting the leading edge of hte flag body to the connector. The length of the connector member is such that substantially the full length of the contracted telescoping sections are received within the connector member length, thereby minimizing the overall axial dimension of the assembly when in the stored, shortened condition. The connector and flag body are easily removed from the extendable standard to facilitate interchange of the flag, or simply removal of the flag to facilitate use of the standard as a communications antenna.

10 Claims, 4 Drawing Sheets

MARINE SIGNAL FLAG

TECHNICAL FIELD

The present invention relates to signal flags and standards for supporting such flags and particularly to a flag mountable to a retractable standard for movement from a below-deck self-stored condition and an extended operative condition.

BACKGROUND OF THE INVENTION

The increased popularity of recreational boating has also increased the popularity of certain water sports such as water skiing in which an individual is pulled at the end of a tow rope at relatively high speeds behind a boat. Such sports as water skiing involve certain hazards, particularly when the participant either falls or lets loose of the tow rope. The individual becomes visually disconnected with the towing vessel and, sinking into the water, becomes increasingly less visible to other boaters in the area.

In recognition of this problem, many states specified certain safety precautions. Firstly, the individuals operating the boat are required to quickly return to a downed skier. At the same time, it is advisable and often required that a signal be displayed, identifying the situation that an individual or individuals are in the water in the vicinity of the boat. As a result, safety-conscious individuals will carry a flag at the end of a fixed standard. When a water sport participant falls or lets go of the tow rope, an individual "spotter" in the boat will immediately elevate the flag and alert the operator of the boat to return immediately to the downed individual. The difficulty that has been experienced, however, is that regardless of the safety consciousness, the flags are misplaced and eventually become unused. This is also due in part to the fact that the "spotter" is often unwilling or unable to hold a signal flag aloft for extended periods of time, especially in a boat that is making a quick turn and a fast return to the downed individual. It is also difficult for the "spotter" to hold the flag aloft while performing other duties such as retrieving the tow rope or skis, etc. dropped by the individual in the water.

In response to the above problem, several attempts have been made to provide signal devices that eliminate the need for an individual to hold a flag aloft.

U.S. Pat. No. 3,602,188 discloses a ski boat warning apparatus. This device includes a flag system that will automatically operate upon release of a tow line to elevate a flag from a stowed condition within an upright, above deck exposed tubular enclosure. The longitudinally rigid flag standard is slidably supported within a tubular enclosure and is spring-biased toward an upward, extended position. The standard is connected to the tow rope through a pulley mechanism so the tension along the tow rope will normally pull the flag standard downwardly into the tube against resistance of the spring. Then, when the skier lets loose of the tow rope, the spring will be allowed to extend and elevate the standard.

The standard is rigid along its entire length and the tubular container for the standard is positioned above the deck surface of the tow boat. Thus, the entire assembly is exposed constantly and may become both a visual and physical obstruction.

Additionally, U.S. Pat. No. 3,602,188 discloses a flag assembly that may be removable from the rigid standard. This is done to enable the standard to be situated in the upwardly extended position when the boat is not being used to pull a skier. Thus, the standard is normally in an upwardly extended position and is retracted into the tubular storage arrangement only when a person applies tension to a tow rope behind the boat.

U.S. Pat. No. 3,786,778 discloses a signal device for water skiing which pivots on the deck of a boat. The base of an extendable standard is mounted to a deck or other exposed surface of the boat to pivot between a relatively horizontal inoperative position and an upright, operative position. The standard telescopes to facilitate upward extension of the signal flag and compact storage of the flag and standard above the mount surface of the boat.

U.S. Pat. No. 4,122,796 discloses another pivoted type signal flag used on water ski boats or the like. Again, this device mounts above a deck surface of the boat and includes a standard that pivots between a horizontal stowed position and an upright operative position.

A substantially similar arrangement to the pivoted flags discussed above is shown in U.S. Pat. Nos. 4,545,320, 3,735,724, and 4,640,213.

Of the above references, none provide a completely adequate solution to the problem of providing a reliable warning system for elevating a signal flag on a marine vessel such as a ski boat, and that will be adequately stowed below deck when not in use.

Another difficulty experienced by recreational boaters is a lack of an adequate antenna for radios. Many recreational boats are supplied with standard AM-FM radios. However, such vessels are very infrequently supplied with extended antennas. This is due at least in part to the fact that the owners do not wish to have the deck surface of the boats cluttered with objects that visually interfere with the typically smooth, sweeping lines of the boat hull and deck configuration. This is also due to the fact that the boats are typically extremely expensive even without "options". Optional items are usually purchased only when there is a demonstrated need. The standard radios supplied with boats operate adequately if the boating area is near a radio transmitter. Thus, antennas are normally avoided as unnecessary additional cost to an already expensive recreational "toy".

The present invention provides an excellent solution to the problems experienced by others in the design of marine safety signal flags, and to the need for radio antennas for marine use.

It is an objective of the present invention to provide a self-storing signalling device that will stow in a subsurface, unobtrusive position such that the standard when not in use will not present a physical or visual obstruction along the deck or other exposed surfaces of a boat.

It is a further objective to provide such a standard mechanism that can be utilized with interchangeable flags. For example, the present flag assembly may be utilized as well for identifying the presence of divers, simply by facilitating exchange of the standard skier or water tow sport signal flag with the standard diver identification flag.

It is a still further objective to provide such a flag arrangement in which the flag may be removed entirely and the standard be utilized as a conventional radio antenna.

It is a still further objective to provide such a device that may be automated to the extent that an operator may simply actuate a switch on a control panel to cause the flag to be elevated or withdrawn below the deck surface.

These and still further objectives and advantages will become apparent upon reading the following detailed description which, taken with the accompanying drawings, disclose preferred forms of the present invention.

BRIEF DESCRIPTION OF THE DRAWINGS

The present invention is exemplified in the accompanying drawings in which.

DETAILED DESCRIPTION OF THE PREFERRED EMBODIMENTS

Figure 1:
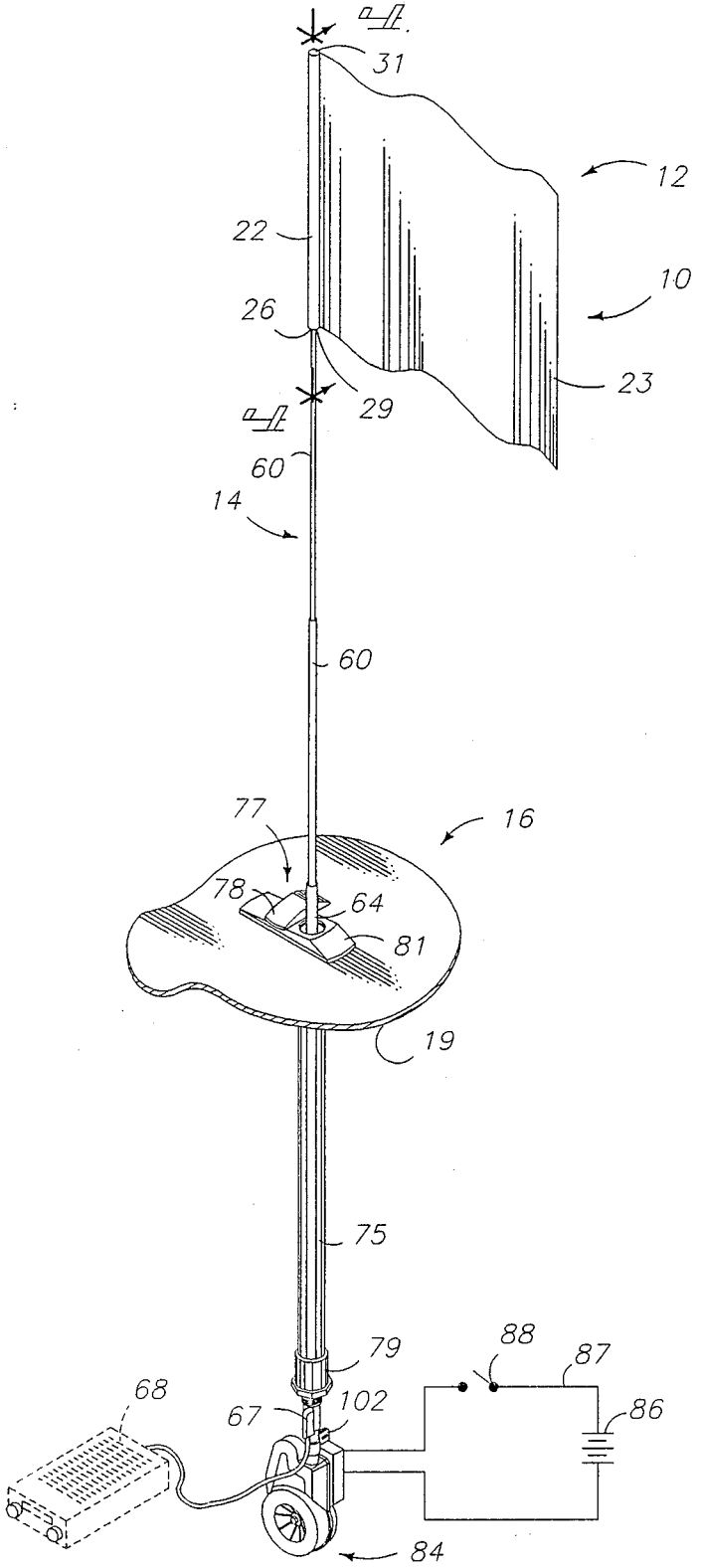
FIG. 1 is a pictorial view of a first preferred form of the present flag in an upwardly extended, operative condition.
Figure 2:
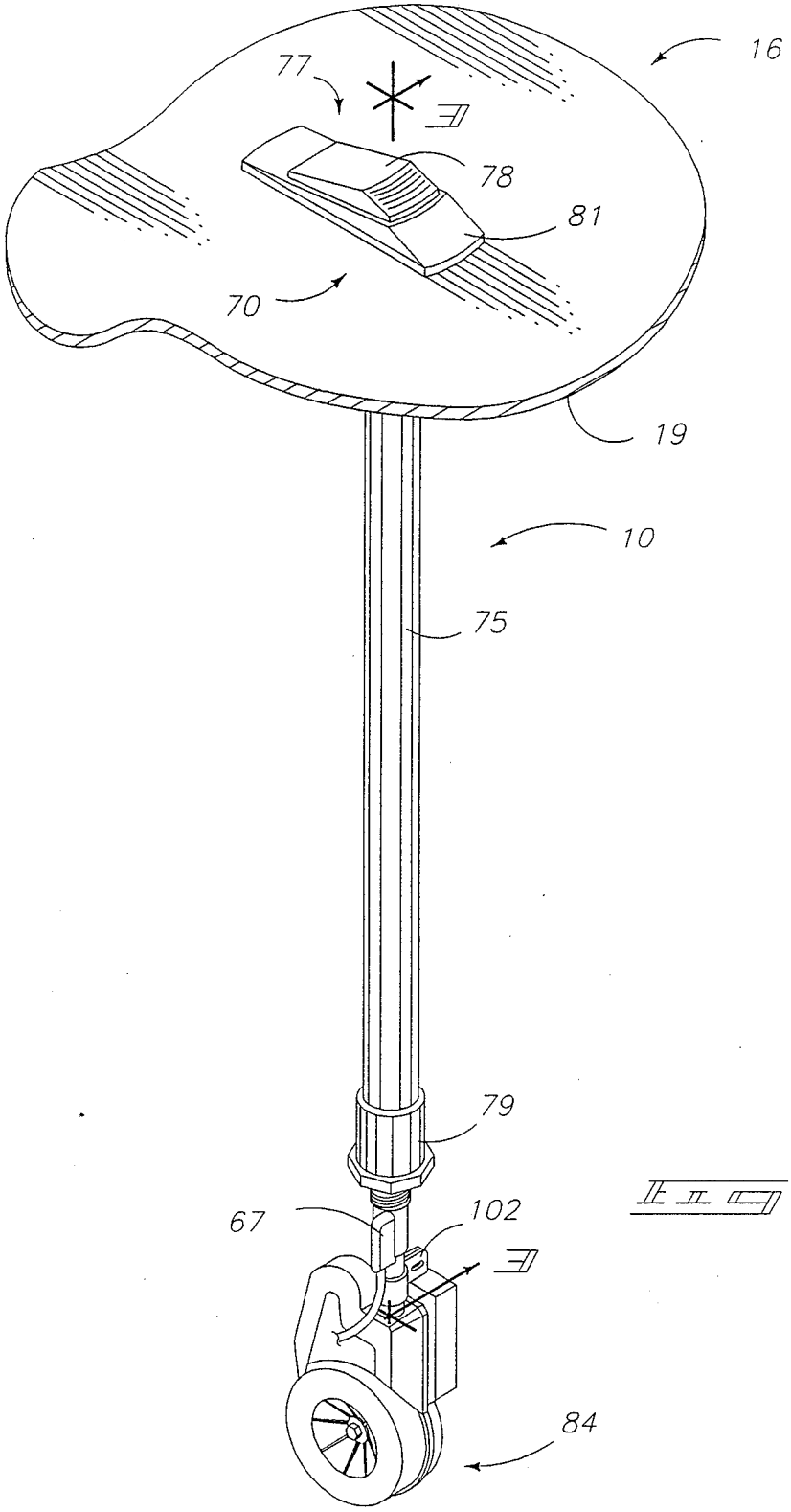
FIG. 2 is a view of the first preferred form in a fully retracted, stowed condition.

The following disclosure of the invention is submitted in furtherance with the constitutional purpose of the Patent Laws "to promote the progress of science and useful arts" (Article 1, Section 8).

A flag assembly exemplifying a preferred form of the present invention is referred to in the drawings by the reference numeral 10.

The assembly, including a flag body 12 and retractable standard 14, is intended primarily for marine use and includes the capability to be mounted to a deck support surface 16. Preferably, the support surface 16 is a deck or other upwardly facing exposed surface having an area along an underside 19 that includes sufficient open vertical space to facilitate mounting of the assembly in a preferred, self-storing configuration.

A preferred flag assembly includes a flag body 12 formed of a flexible material such as nylon or the like. The flag body 12 may take any standard configuration such as the one foot by one foot square configuration commonly used for warning of downed water skiers. The flag might also be otherwise configured to indicate other situations as, for example, the standard divers' warning flag.

The flag configuration will include a leading edge 22 and a trailing edge 23. A pocket 26 may be formed in the flag body by folding an edge of the flag body onto itself and attaching the edge to the flag body. The fold may be secured across one end and along the flag body by standard fastening techniques such as sewing, adhesive, etc. The pocket 26 preferably formed will extend from an open end 29 at a bottom end of the leading edge 22 to a closed end 31 at a top end of the leading edge 22.

Another important aspect of the present flag is a connector member 35. The connector member 35 is receivable over a selected length of the retractable standard 14. It is hollow along its length between a top end 36 and an open bottom end 37. A central bore 38 extends between the top and bottom ends 36, 37.

Figure 3:
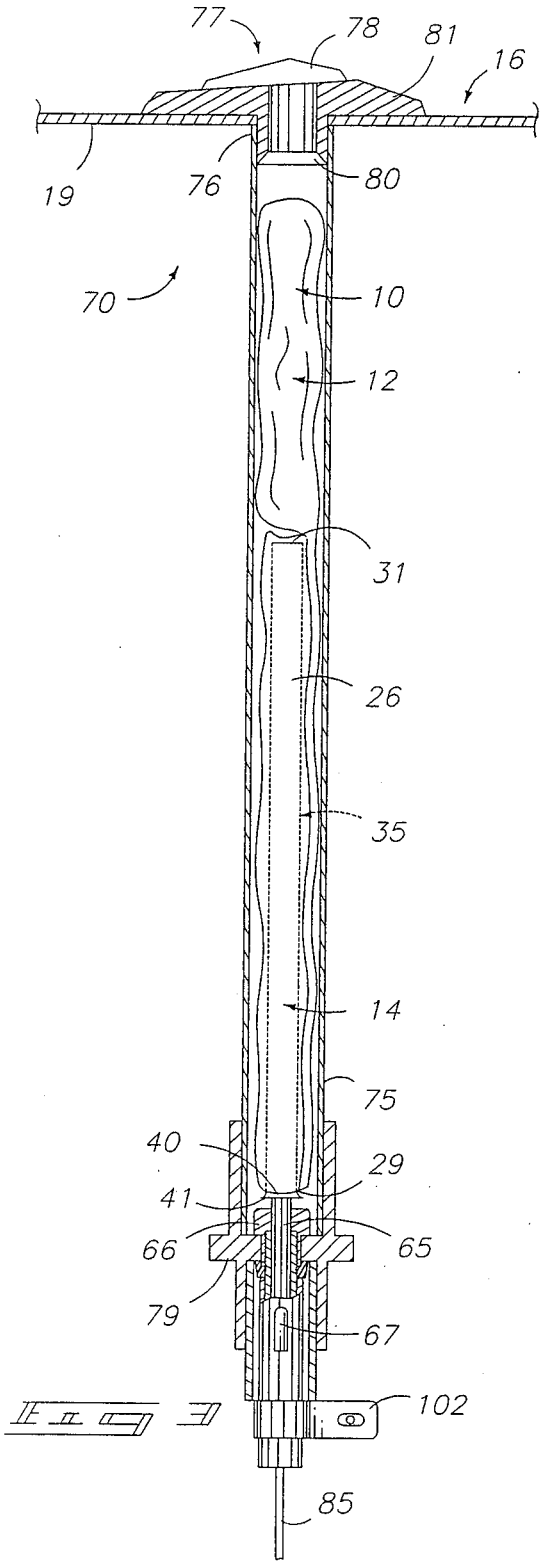
FIG. 3 is a fragmented sectional view taken substantially along line 3—3 in FIG. 2.

The bore 38 is larger in cross sectional diameter than the corresponding largest diameter of the standard 14. The connector member 35 will therefore loosely receive and overlap at least a portion of the standard length when the standard is fully extended as shown in FIG. 1. The connector member 35 will also preferably overlap substantially the full retracted length of the standard (FIG. 3). This facilitates full retraction of the standard and storage of the flag within a confined space below the deck surface 16.

In a preferred configuration, the connector 35 and flag body are releasably connected by means at the respective upper and lower ends of the connector and flag pocket. Such means includes the closed top end of the pocket 26 formed in the flag body. The closed top end 31 of the pocket fits over the connector to secure the flag body to the upper or top end 36 of the connector. A collar 40 on the connector member secures the flag body to the connector member at the pocket open end 29.

Figure 4:
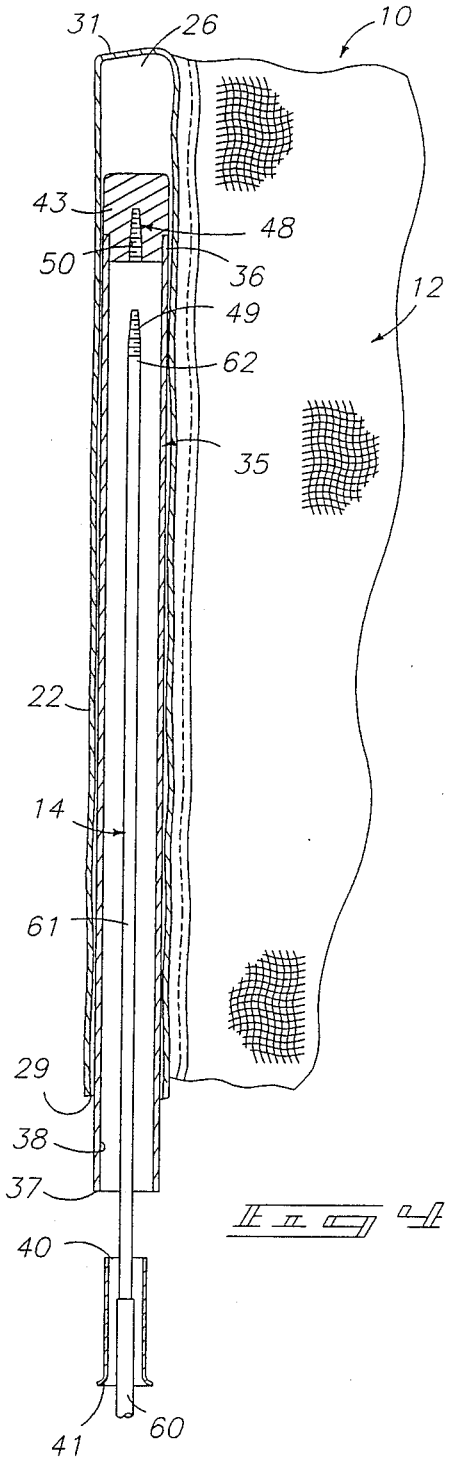
FIG. 4 is an enlarged partially exploded sectional view of a top section of the flag and standard section taken substantially along line 4—4 in FIG. 1.

The collar 40 is slidably received within the open bottom end of the connector and is useful to overlap and secure a length of the pocket 26 within the connector bore 38. To this end, the bottom 41 of the collar 40 is flared outwardly to compress the flag pocket end 29 against the bottom connector end 37 (FIG. 4). The flared bottom 41 is also useful in preventing undesirable engagement between the connector bottom end 37 and telescoping sections of the standard 14.

An attachment fitting 43 is provided on the connector member for securing the connector member 35 and flag body 12 to the retractable standard 14. The fitting 43 is positioned at the top end 36 of the connector member 35 so the telescoping sections of the standard may be selectively retracted at least partially and preferably substantially completely into the connector member between its top and bottom ends, 36, 37.

In a first preferred form, the fitting 43 is comprised of a receptacle 48 for releasably receiving the top end of the top standard section. An example of a preferred receptacle 48 includes a threaded socket 50 having internal threads turned to mate with male threads 49 at the top end of standard 14. This form of receptacle 48 enables the connector member 35 and flag body 12 to be easily attached to and removed from the standard 14.

In another preferred example, the receptacle is provided in the form of a socket 52 (FIG. 6) adapted to be releasably fitted over a top bead 53 at the top of standard 14. The receptacle, including socket 52, is preferably formed of a substantially resilient material to enable the socket to be "snapped" over the bead 53 at the top of standard 14. Thus, the associated connector member 35 and flag body 12 may be easily attached to the standard simply by axially pressing the socket 52 over the bead 53. The connector member and flag body can be as easily removed simply by pulling the socket upwardly to disengage the bead 53.

The standard 14 is provided in a number of slidably interfitting telescoping sections 60. The sections extend from a top section 61 at the standard top end 62 to a bottom section 64. A base area 65 is provided on the bottom section 64 with clamp fittings 66 (FIG. 3) for securing the standard to a tubular sleeve base 79.

The telescoping sections 60 are preferably formed in substantially equal lengths of approximately 12 inches. It is preferred that at least five of the sections be provided such that the total extended length of the sections be approximately four to five feet.

It is advantageous that all of the telescoping sections 60 be constructed of a rigid corrosion resistant metal such as stainless steel. Such material strengthens the standard and facilitates further use, if desired, as an antenna for a communications device such as a standard AM-FM radio 68 (FIG. 1). To this end, a conventional connector 67 may be provided on the standard for electrical attachment to a conventional communications device such as the radio 68 shown by dashed lines in FIG. 1.

Further details relating to the telescoping sections 60, mounting arrangements 66, and antenna connector 67 of the standard will not be discussed in further detail. Such components are well known in the art.

In a first preferred form, a surface mounting device 70 is provided for mounting the retractable standard 14 and flag body 12 to a support surface 16. The device 70 is specifically provided such that the standard and flag body may be situated in an out-of-sight, fully retracted inoperative position, to the underside 19 of the deck surface 16.

The surface mounting device 70 advantageously includes an elongated tubular sleeve 75. The sleeve 75 is sufficiently long to receive the fully retracted standard 14 and the flag body 12 below the deck surface 16. The sleeve extends between an open top end 76 (FIG. 3) to a closed base 79.

A cap 77 is provided with a flange 80 slidably mounting the open top sleeve end 76 to secure the sleeve 75 in position on the supporting deck surface 16. An insulator lined opening extends through the cap 77 and into the hollow interior of the sleeve 75 to provide passage for the flag body and standard.

The cap 77 may include a slidable cover 78 mounted to a base 81. The base 81 is adapted to secure the cap to the deck surface 16. The cover 78 is movably mounted to the base 81 and selectively spans the cap opening and the open top end 76 of the sleeve 75. The cover 78 is pivotable to a position beside the cap opening and open sleeve top end 76 (FIG. 1) to enable extension and retraction of the flag body 12 and standard 14. When closed, the cover 78 will visually conceal the flag and standard. It will also prevent water and debris from collecting within the sleeve when the present assembly is stored below the support surface.

The tubular sleeve base 79 receives the standard 14, which is secured thereto by the clamp fittings 66. The base 79 and fittings 66 secure the standard in a centered, upright location within the sleeve 75 so the standard and flag body may move axially therein.

A length of the standard base area 65 projects below the sleeve base 79 to be operably secured to a power drive 84. A useful power drive 84 is identified as model QM1 or QM2, produced by Harada Industries of America, Inc., 1650 West Artesia Boulevard, Gardena, California 90248-3297. Harada Industries of America, Inc. is also a supplier of the conventional standard components discussed above.

The power drive 84 is selectively operable to move the standard from the operative position shown in FIG. 1 to the inoperative, shortened storage position shown in FIG. 3. A flexible cable 85 (FIG. 3) of the power drive 84 is connected to the extendable sections 60 in a conventional manner.

The power drive 84 is connectable to a power source 86 (FIG. 1) which may be a battery or other source of electrical energy. The connection is accomplished by means of an appropriate electrical circuit 87 including a switch 88 for operation to selectively activate the drive. The switching arrangement 88 may be any of several commercial switching devices provided by the above-referenced supplier.

Figure 5:
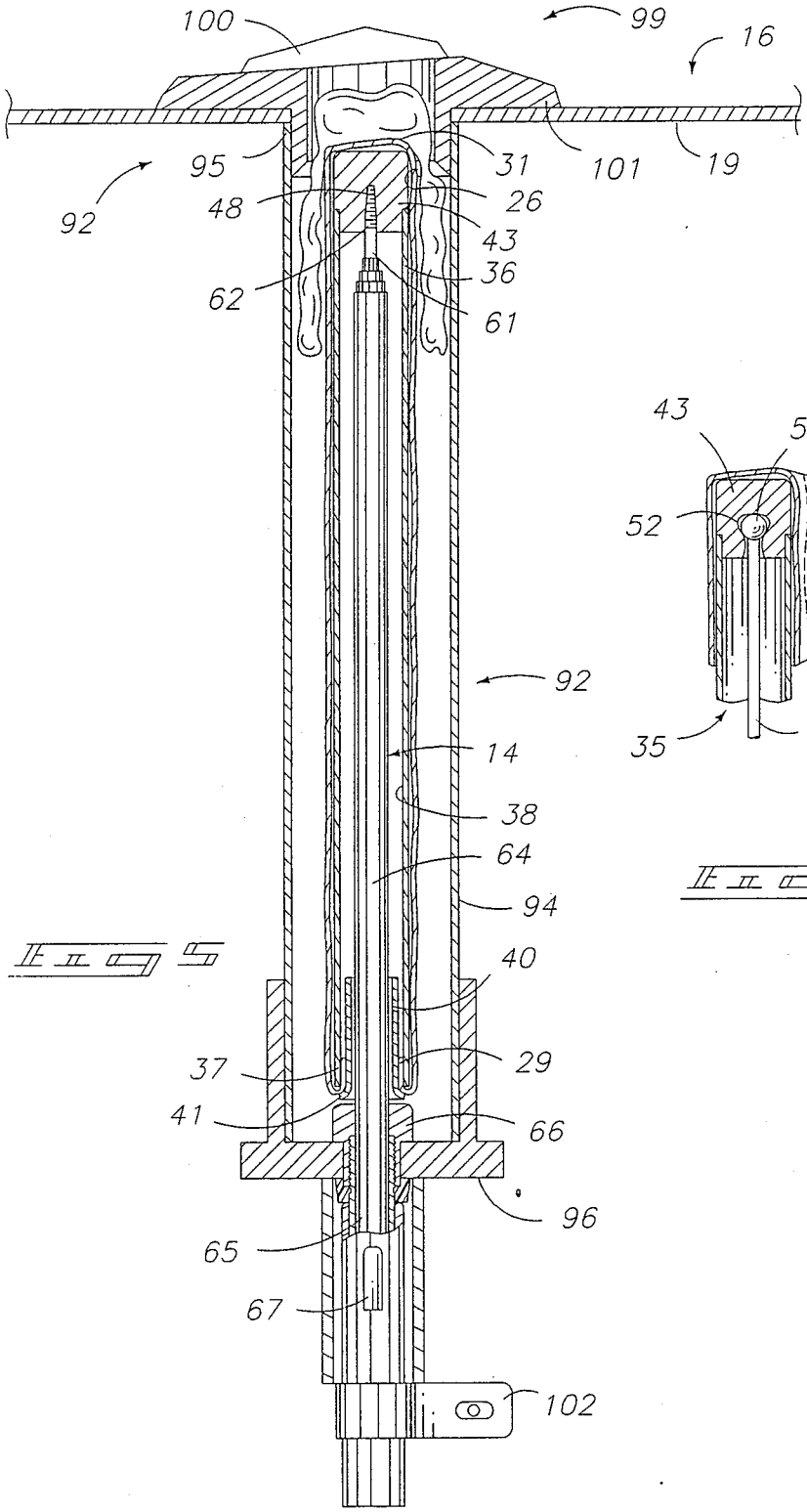
FIG. 5 is a sectional view showing a manual version of the present flag in a fully retracted, stowed condition.

An alternate surface mounting device 92 is utilized to mount the standard 14 as shown in FIG. 5. In this version, the standard 14 and flag body 12 may be selectively extended and retracted by hand.

The manually extendable standard 14 is received within a sleeve 94 mounted below the deck surface 16 by a cap 99. Sleeve 94 is larger in diameter than sleeve 75 to allow finger access to the internal bore. Sleeve 94 may also be somewhat shorter in length than the sleeve 75 since there is no power drive. Further, it is desirable to maintain the flag close to the opening of the cap 99 to further facilitate finger access.

The fitted cap 99 may be substantially identical to the cap 77 except for dimensions that are changed to accommodate the larger diameter sleeve 94. Thus a cover 100 and a cap base 101 correspond substantially with the cover 78 and cap base 81 described above.

In this embodiment, the base section 65 of the standard 14 is secured to the sleeve base 96 by the fittings 66. The base section may be provided to extend on downwardly below the closed end of the sleeve 94 to expose the antenna connector 67.

Either of the above described forms of the present flag assembly 10 is mounted to a support surface 16 on a boat, such as a deck, simply by first drilling a hole through the deck surface. An area is selected having sufficient clearance beneath the deck underside 19 to facilitate mounting of the tubular sleeve 75 or 94.

With the various features described above, positioning the assembly is a relatively simple matter due to the fact that the overall length of the entire assembly when retracted to the shortened, inoperative condition, is typically less than applicable vertical dimensions between the deck surface of a recreational boat and its hull.

The flag assembly is secured to the deck surface by the surface mounting device 70. The cap base 81 or 101 is positioned over the drilled hole and is attached by means of conventional screws, adhesive, or other appropriate fastening mechanisms. The tubular sleeve 75 (or alternatively, the tubular sleeve 94) is attached to the underside of the deck and to the cap base 81 (or cap base 101). This may be accomplished by a friction fit between the interfitting sleeve flange sections of the cap and sleeve 75 (or 94) and by use of a conventional fastener (not shown). If applicable, the sleeve may be further secured to the boat by provision of an appropriate mounting bracket 102 attached to the base end 65 of the standard.

The present flag assembly is now mounted to the boat. The remaining connections simply involve standard electrical connections to the electrical supply for the boat, and mounting of the switching arrangement 88. Further, if desired, the standard may be connected by conventional means to a radio.

Once installed, operation of the first preferred form of the present flag assembly is a simple matter of pivoting the cover 78 and operating the switch 88. Thus, when a skier releases the tow rope, or falls, the boat operator, or an individual in the towing boat may simply slide the cover 78 to one side and operate the switch 88 to close a circuit to the power drive 84. This results in extension of the standard telescoping sections 60 and elevates the flag body 12 from its below deck, concealed position to a highly visible operative position.

The flag body 12 will automatically unfurl from the tubular sleeve 75 as it is elevated away from the confines of the sleeve. Unfurling is assured by the relatively rigid nature of the connector member 35 and the secure attachment of the flag body at the leading edge, stretching between the top and bottom connector ends.

When the conditions dictate, the switch may again be operated to lower the flag. This is again accomplished by appropriate actuation of the switch 88. The drive unit 84 thus retracts the telescoping sections 60, pulling them downwardly into the tubular sleeve 75.

It is important to note that accumulating telescoping sections are progressively received within the tubular connector 35 as it is drawn downwardly into the tubular sleeve 75. The flared end 41 of collar 40 guides the sections into the connector 35 until nearly all of the accumulated lengths of sections 60 are contained within the connector.

As the sections retract into the tubular sleeve 75, the flag body is automatically furled about the connector 35, between the external surfaces of the connector and the internal facing surfaces of the tubular sleeve 75.

The flag will consistently furl in this manner for each operation due in part to the flexible nature of the flag body and to the attachment of the leading edge at the top and bottom ends of the connector 35.

The tubular sleeve 75 is of sufficient dimension to assure full retraction of the flag body 12, so no portions of the flag will remain above the cap 77. The cap slide 78 may then be pivoted to close the open top end of the sleeve.

Operation of the manual version involves steps similar to those described above with the exception that the standard 14 is manually moved between the shortened, storage orientation and the upright, operative position. Thus, the user simply pivots the slide cover 100 to expose the opening of the tubular sleeve 94 and to gain access to the top end of the standard 14. The flag body and the top end of the connector are then grasped and pulled upwardly. The flag automatically unfurls as described above when the trailing edge clears the top end of the tubular sleeve 94.

The manual standard may be retracted simply by grasping the connector member 35 and urging the telescoping members downwardly. The gathered standard sections and flag body are progressively received within the length of connector member 35 in the same manner as described above and shown in FIGS. 5 and 3 with the exception that the user may wish to manually stuff the flag body downwardly into the sleeve 94.

Figure 6:
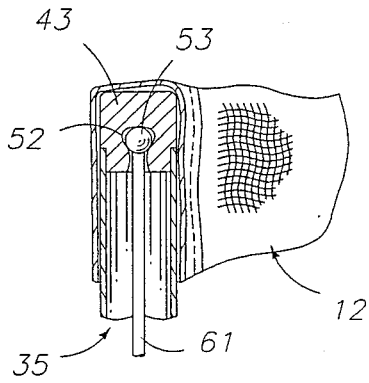
FIG. 6 is an enlarged detailed view of an alternate standard attachment fitting by which the flag body is attached to the retractable standard.

Should the user wish to change or replace the flag body 12 on either version described above, removal is accomplished simply by unscrewing the fitting 43 shown in FIG. 4 or by simply pulling the FIG. 6 fitting version upwardly to disengage it from the standard. The connector member and flag body are thereby easily removed from the standard. A different flag body can then be mounted to the connector 35, or a new flag body and connector assembly may be provided for selective attachment to the standard.

The flag body and connector member may also be selectively removed from the standard to permit use of the standard as a communications antenna. Thus, the standard may function in an antenna mode, without the flag body which could otherwise falsely indicate the presence of individuals in the water about the boat.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the Doctrine of Equivalents.

I claim:

1. A self storing signal flag for subsurface mounting to a support surface, comprising:

a retractable standard having telescoping standard sections extendable to an operative exposed elongated condition and retractable to a shortened storage condition;

a connector member including a top end and a bottom end loosely receivable over a portion of the standard to enable at least a portion of the standard to be retracted into the connector member between the top and bottom ends thereof;

a fitting on the connector member for securing the connector member to the retractable standard;

a flag body formed of a flexible material and including a leading edge securable to the connector member, and a trailing edge; and a surface mounting means for mounting the retractable standard and flag body to the support surface with the flag body and the standard situated underneath the supported surface when the standard is retracted to the shortened storage condition thereof.

2. The self storing signal flag for subsurface mounting to a support surface, as claimed by claim 1 further comprising:

a power drive means connected to the retractable standard for extending and retracting the retractable standard.

3. The self storing signal flag for subsurface mounting to a support surface, as claimed by claim 1 wherein the deck surface mounting means comprises:

a tubular sleeve adjacent the retractable standard for containing the retracted length of the standard and the flag body.

4. The self storing signal flag for subsurface mounting to a support surface, as claimed by claim 1 wherein the connector member is tubular, with a central bore for loosely receiving a length of the telescoping standard sections.

5. The self storing signal flag for subsurface mounting to a support surface, as claimed by claim 4 wherein the central bore is elongated to receive substantially the full prescribed retracted length of the standard when in the shortened storage condition thereof.

6. The self storing signal flag for subsurface mounting to a support surface, as claimed by claim 4 wherein the retractable standard includes a top section and wherein the bore is of a length to substantially receive the top section of the telescoping standard sections therein.

7. The self storing signal flag for subsurface mounting to a support surface, as claimed by claim 1 wherein the connector member is rigid along its length and includes means for securing the leading edge of the flag body to the top and bottom ends of the connector member.

8. The self storing signal flag as claimed by claim 1 wherein the standard includes a top section with a threaded top end and the fitting includes a receptacle at the top end of the connector member, the receptacle being threaded to be releasably mounted to the threaded top end of the standard top section.

9. The self storing signal flag as claimed by claim 1 wherein the standard includes a top section with a top end and the fitting includes a receptacle at the top end of the connector member, the receptacle including a socket to be releasably secured to the top end of the standard top section.

10. The self storing signal flag as claimed by claim 1 wherein the standard is an antenna and includes a connector for electrical connection to a communication device.

* * * * *